US006443703B1

(12) United States Patent
Hugenroth

(10) Patent No.: US 6,443,703 B1
(45) Date of Patent: Sep. 3, 2002

(54) SCROLL COMPRESSOR WITH MOTOR PROTECTOR IN SUCTION FLOW PATH

(75) Inventor: Jason Hugenroth, Hope, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/707,304

(22) Filed: Nov. 7, 2000

(51) Int. Cl.[7] ..... F04B 49/10
(52) U.S. Cl. ..... 417/32; 417/279
(58) Field of Search ..... 417/32, 33, 292, 417/18, 279

(56) References Cited

U.S. PATENT DOCUMENTS 4,877,382 A * 10/1989 Caillat et al. ..... 418/55
5,118,260 A * 6/1992 Fraser, Jr. ..... 417/18
5,368,446 A * 11/1994 Rode ..... 417/18
5,707,210 A * 1/1998 Ramsey et al. ..... 417/32
6,179,589 B1 * 1/2001 Bass et al. ..... 418/55.1

* cited by examiner

*Primary Examiner*—Teresa Walberg
*Assistant Examiner*—Thor Campbell
(74) *Attorney, Agent, or Firm*—Carlson, Gaskey & Olds

(57) ABSTRACT

Motor protectors are positioned in a location in a scroll compressor where they are cooled by suction refrigerant flow. If the volume of refrigerant flow decreases, then the cooling effect also decreases. In this way, the protector becomes more sensitive to the mass flow of refrigerant. Thus, the motor protector is more likely to trip in a loss of charge situation.

13 Claims, 5 Drawing Sheets

SCROLL COMPRESSOR WITH MOTOR PROTECTOR IN SUCTION FLOW PATH

BACKGROUND OF THE INVENTION

This invention relates to a scroll compressor wherein a motor protector is placed in a location such that suction refrigerant cools the protector. Thus, upon a reduction in the refrigerant mass flow the protector will become heated, and trip.

Scroll compressors are becoming widely utilized in refrigerant compression applications. In a scroll compressor a pair of scroll members each have a base and a generally spiral wrap extending from the base. The wraps interfit to define compression chambers. One of the two scroll members is caused to orbit relative to the other. As the wraps orbit relative to each other, the size of the compression chambers decreases and an entrapped refrigerant is compressed.

There are many challenges with scroll compressor design. One of the challenges relates to the mass flow through the compressor. The compressors are typically incorporated into a refrigerant cycle, and there is the possibility of loss of charge in the refrigerant from any spot in the cycle. During a loss of charge situation, the mass of refrigerant flowing through the compressor decreases. Continued operation at loss of charge situations can have undesirable side effects. Thus, there is an effort to identify loss of charge situations.

One protection element incorporated into compressors is a motor protector. A motor protector senses several variables within the compressor housing, and stops operation of the electric motor driving the compressor should conditions indicate some problem with the compressor or its associated refrigerant cycle. Typically, the protector is actuated by an anomaly in the power supply to the electric motor (i.e., a spike in voltage or current) or, due to excessive heat. Motor protectors have been typically incorporated into the windings of the motor stator. Thus, the motor protector has typically been removed from the compressor pump elements, and away from any location likely to be effected by the refrigerant flow.

SUMMARY OF THE INVENTION

In a disclosed embodiment of this invention, a motor protector is positioned in a sealed compressor at a location such that it will be exposed to the flow of suction refrigerant. The motor protector is thus cooled by the suction refrigerant, and the suction refrigerant thus reduces the likelihood of the protector tripping. As known, the motor protectors have circuitry that enable them to trip if there is an electrical anomaly, or if there is an increase in temperature beyond a predetermined amount. The predetermined amount can be designed into the protector. With the present invention, the predetermined amount is designed such that it anticipates the flow of suction refrigerant over the protector to cool the protector. Thus, the predetermined amount might be somewhat lower than would typically be the case with a motor protector.

Should there be a reduction in the mass flow of refrigerant, the protector will no longer be cooled by the suction refrigerant to the same extent. The motor protector is then more likely to exceed a trigger temperature and trip, stopping operation of the motor. In embodiments of this invention, the protector is positioned either axially spaced away from the windings, or radially outward of the windings. Preferably, the protector is positioned in the path of the suction refrigerant. This can be achieved in any of several ways.

In one general category of embodiments, the protector is positioned spaced adjacent the suction tube. In this way, the suction fluid is directed onto the protector. Various structures may be associated with the protector such as a baffle, or a shield of some type. These structures increased the sensitivity of the protector to the mass flow of suction refrigerant. Alternatively, a heat pipe can conduct heat away from the protector to a location at which the heat pipe is cooled by the suction refrigerant. Again, should the mass flow of suction refrigerant decrease, the heat transfer from the protector will decrease and the protector is then likely to trip.

In other embodiments of this invention, the protector may be surrounded by the start windings of the motor. In this way, the protector is heated, and if not cooled by the suction refrigerant, it will trip.

Various other ways of transferring heat from the protector through the refrigerant flow are disclosed.

These and other features of this invention can be best understood from the following specification and drawings, the following of which is a brief description.

DETAILED DESCRIPTION OF A PREFERRED EMBODIMENT

Figure 1:
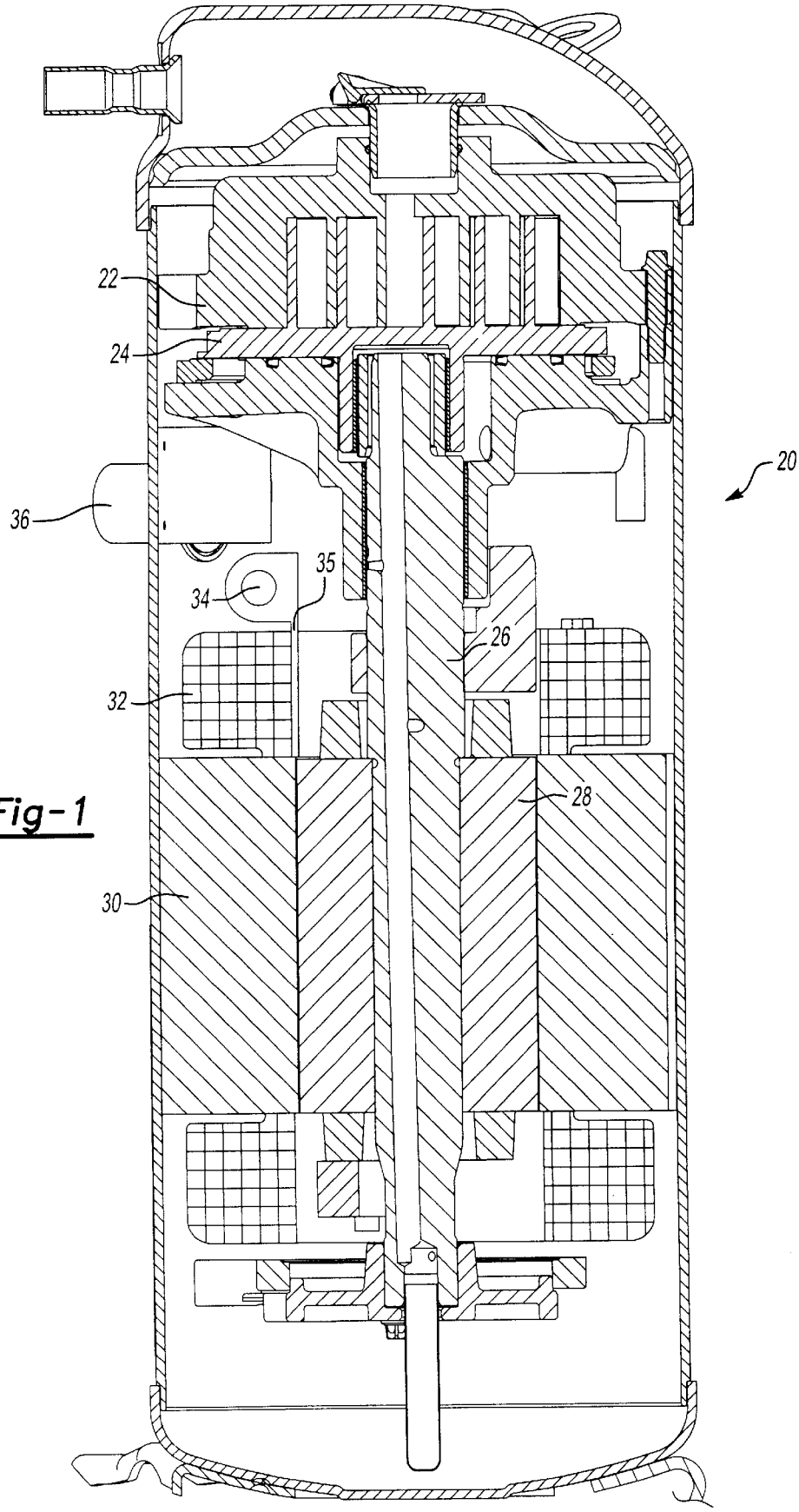
FIG. 1 shows a first embodiment scroll compressor.

FIG. 1 shows a scroll compressor 20 incorporating a non-orbiting scroll 22 interfitting with an orbiting scroll 24. As is known, a shaft 26 drives the orbiting scroll 24. The shaft 26 is driven by a motor rotor 28 which is driven by a motor stator 30. As known, windings 32 on the stator 30 are associated with a motor protector 34. However, contrary to the prior art, the motor protector 34 is positioned within a holder 35 such that it is spaced axially from the windings in a direction toward the suction tube 36. Now, during operation of the scroll compressor shown in FIG. 1, the suction refrigerant entering the compressor through the suction tube 36 will pass over the protector 34 and its holder 35, cooling the protector. In this way heat is taken away from the protector. However, should the mass flow of refrigerant decrease, as would be the case in a loss of charge situation, then heat transfer will also decrease. At that time, the motor protector is likely to reach its trigger temperature. This stops operation of the motor. This embodiment of the invention thus increases the sensitivity of the motor protector to the conditions actually existing within the pump portion of the compressor. Typically, the motor protector has been built into the windings, and was not as sensitive to the conditions in the compressor, or to the mass flow of refrigerant.

Figure 2:
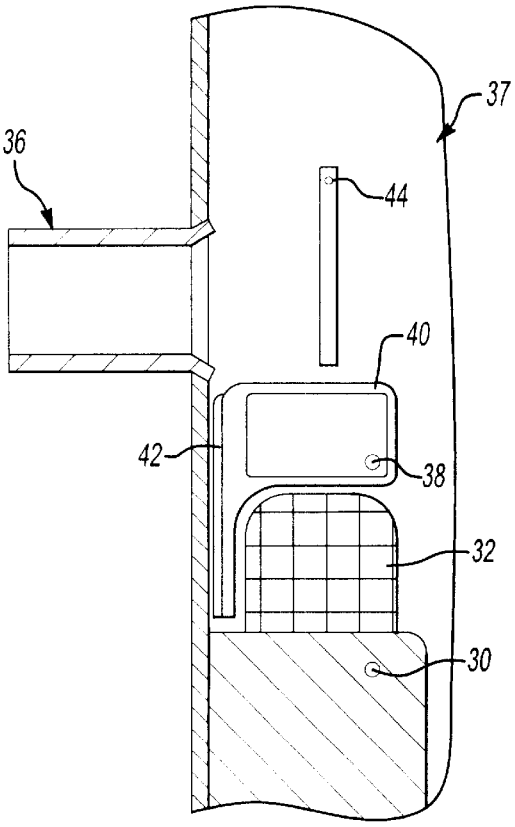
FIG. 2 shows a second embodiment scroll compressor.

FIG. 2 shows another embodiment 37 in which the motor protector 38 is in a holder 40 positioned radially inward of a housing shell 42, but outward of the windings 32. A suction baffle 44, as known, is connected to the housing shell 42 on positions circumferentially spaced (not shown) from the suction tube 36. Now, when suction refrigerant enters the tube 36 it is directed both upwardly towards the compressor, but also downwardly over the protector 38. Again, when the mass flow of that refrigerant decreases, the heat transfer away from the protector will decrease.

Figure 3:
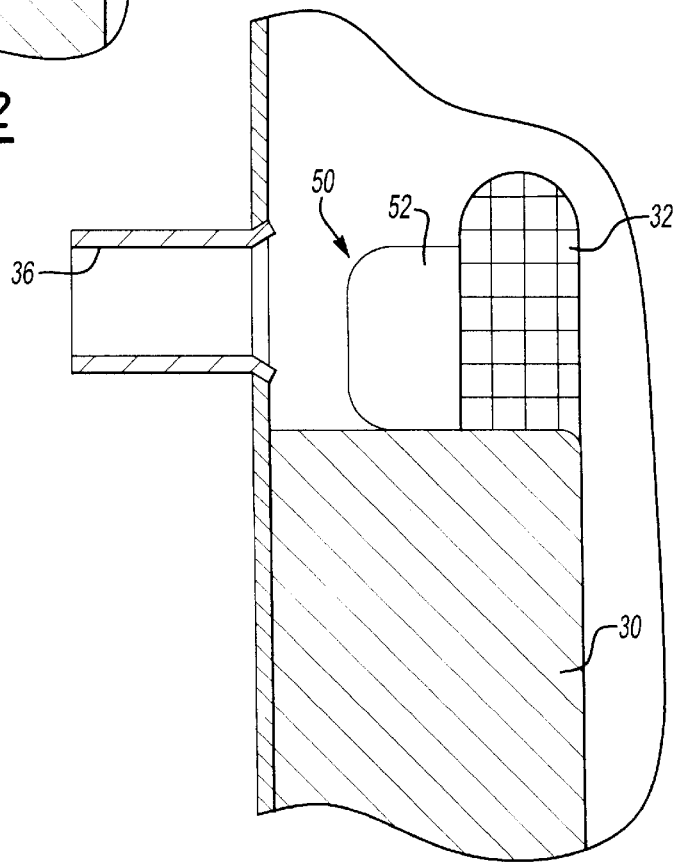
FIG. 3 shows a third embodiment scroll compressor.

FIG. 3 shows another embodiment wherein the motor protector 52 is positioned radially outwardly, but axially aligned with the winding 32. In this embodiment, the protector 52 is aligned with the suction tube 36.

Figure 4:
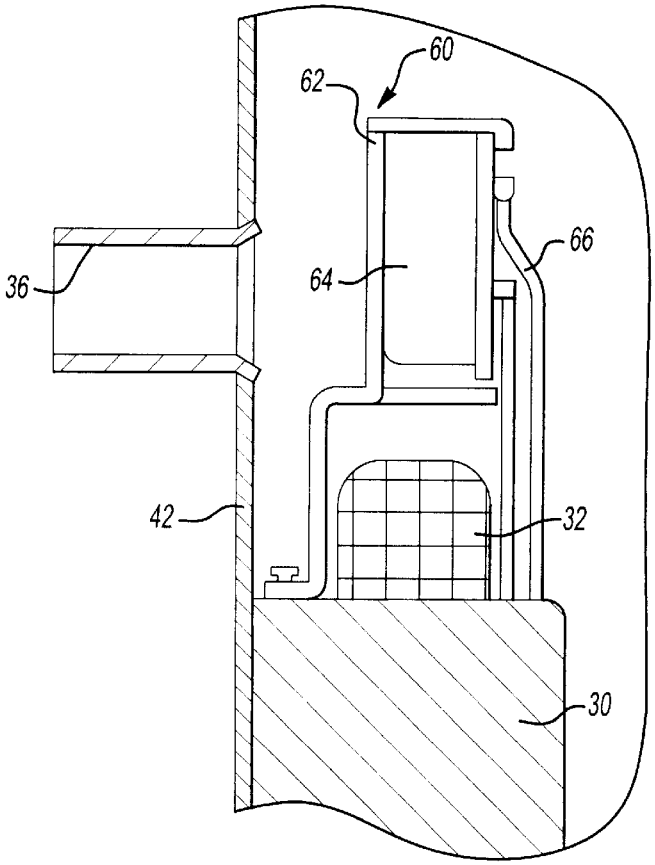
FIG. 4 shows a fourth embodiment scroll compressor.

FIG. 4 shows another embodiment 60 wherein a holder 62 holds the protector 64. Electric connections 66 communicate to the protector 64. Again, the protector 64 and its holder 62 are positioned to be spaced radially inward, but aligned with the suction tube 36.

Figure 5:
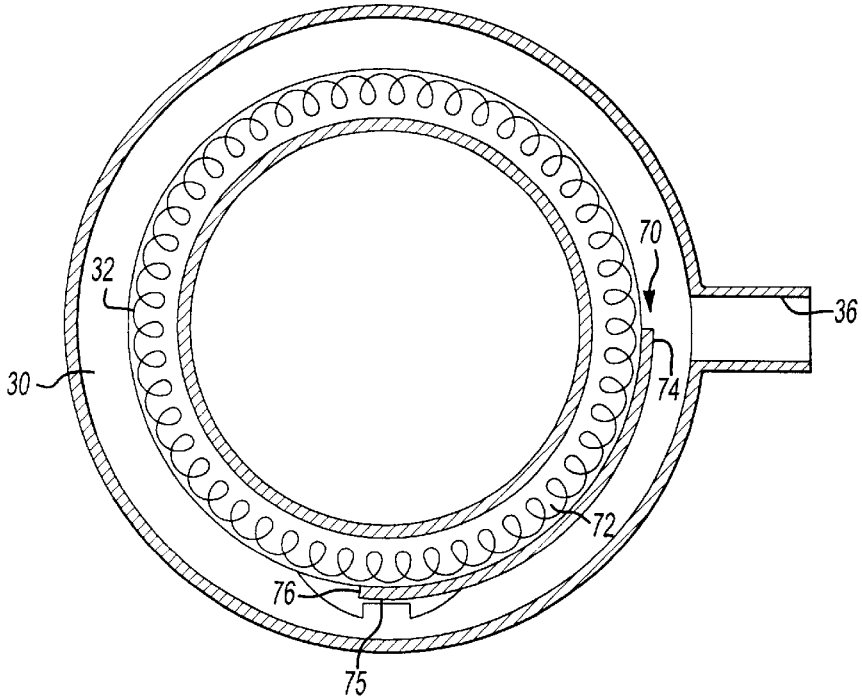
FIG. 5 shows a fifth embodiment scroll compressor.
Figure 6:
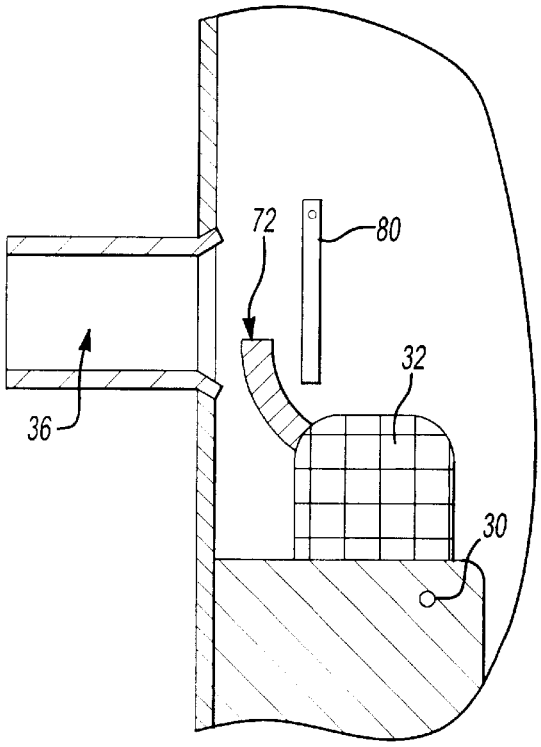
FIG. 6 shows a sixth embodiment scroll compressor.
Figure 7:
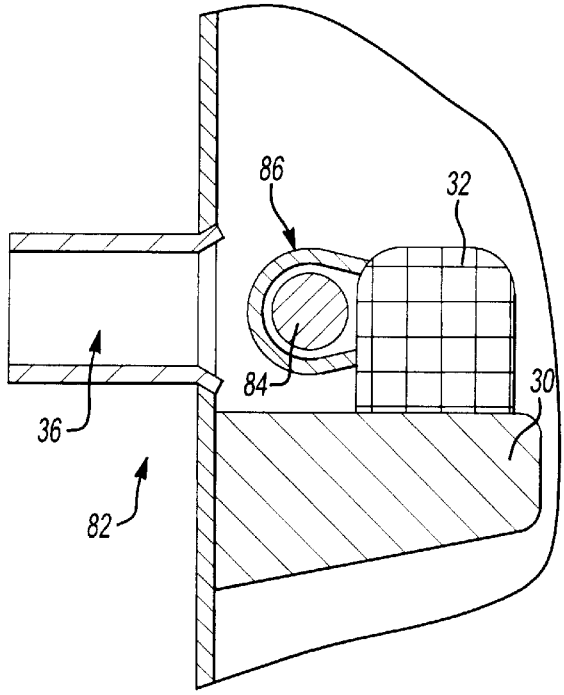
FIG. 7 shows a seventh embodiment scroll compressor.
Figure 8:
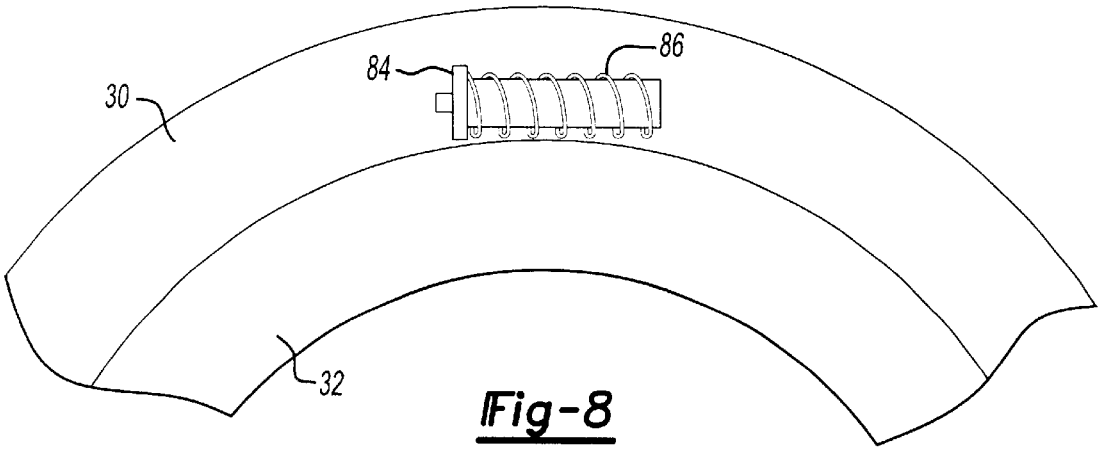
FIG. 8 is a top view of the FIG. 7 embodiment.

FIG. 5 shows yet another embodiment 70 wherein a heat tube 72 has an end 74 positioned in front of the suction tube 36 and another end 35 connected to the motor protector 36. FIG. 6 is an embodiment similar to the FIG. 5 embodiment, however, also incorporating a baffle 80 to direct the refrigerant onto the heat tube 72. The heat tubes in the FIG. 5 and FIG. 6 embodiments take heat away from the motor protector. As suction refrigerant flows over the heat tube 72 at its end 74, the heat is taken away. However, should the mass flow of refrigerant through the suction tube decrease, the heat transfer will also decrease. This embodiment is similar to the other embodiments in that the motor protector is effectively operatively connected with a position spaced from the windings, and in the path of the suction fluid. Heat tubes transfer heat at rates many times faster than the best known conductor, copper. Heat tubes are known in the art. One such device is disclosed in U.S. Pat. No. 3,700,028. FIG. 7 shows yet another embodiment 82. In embodiment 82, the protector 84 is surrounded by a portion of the start windings 86. The start windings 86 are a known component in the winding portion 32 of an electric motor incorporated into a sealed compressor. As can be appreciated from FIG. 8, the windings surround the protector 84. The protector 84 is positioned inward of the suction tube 36 as in the prior embodiments. Now, during operation of the compressor, the start windings heat the protector. If sufficient suction refrigerant is not flowing over the protector, then the protector will quickly heat to its trigger temperature.

Figure 9:
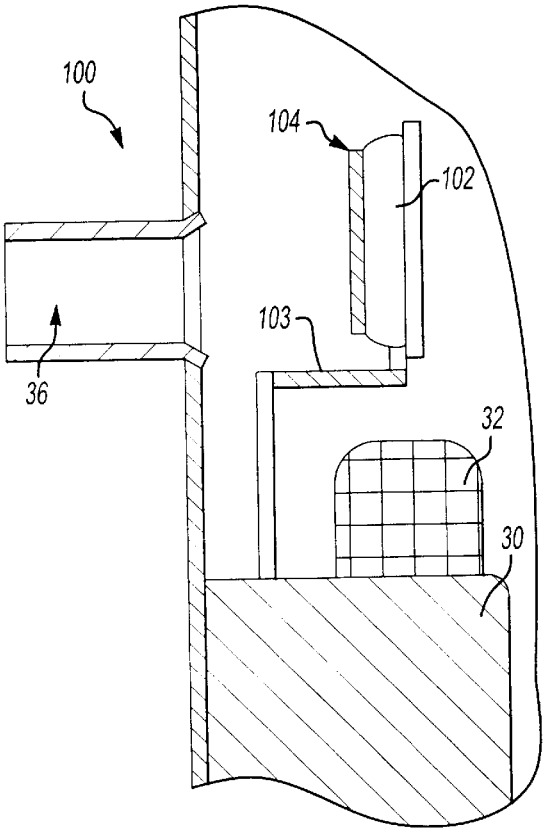
FIG. 9 shows an eighth embodiment scroll compressor.

FIG. 9 shows another embodiment 100 wherein the protector 102 is mounted onto a holder 103 adjacent the windings 32. A protector front face cover 104 becomes less thermally conductive at higher temperatures. Thus, during a loss of charge situation, when the temperatures increase, it will be less effective at transferring heat away from the protector. Examples of acceptable materials include di-electric metal phase transition materials such as may be utilized in temperature controlled capacitors.

Figure 10A:
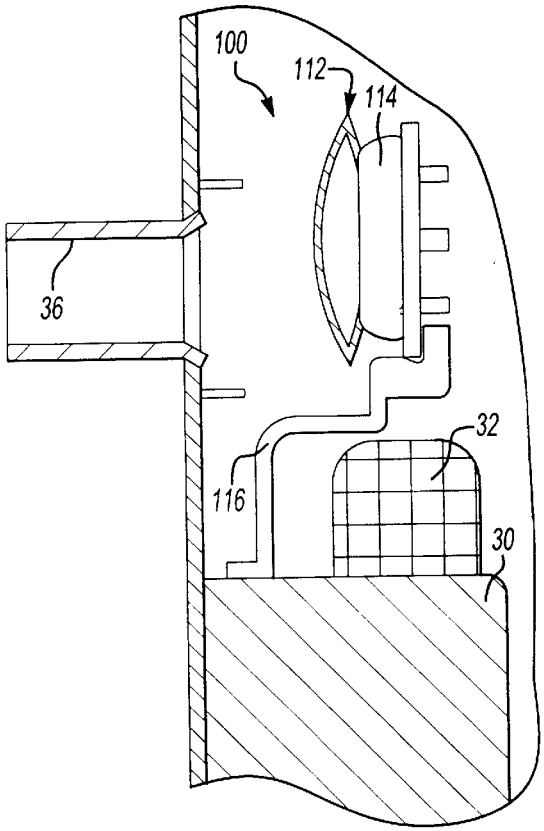
FIG. 10A shows a ninth embodiment scroll compressor.
Figure 10B:
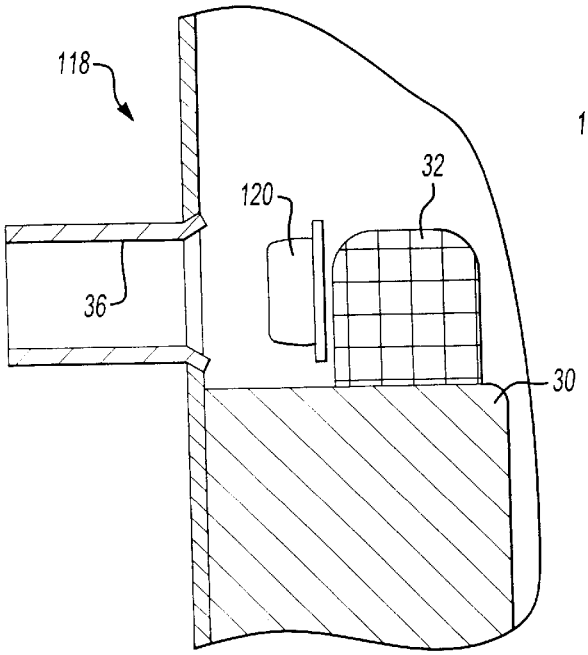
FIG. 10B shows a tenth embodiment scroll compressor.

FIG. 10A shows yet another embodiment 110 wherein a fluid filled pillow 112, which is filled with a fluid having good heat transfer characteristics is positioned forward of the protector 114. Protector 114 is mounted on a holder 116 as in the prior embodiments. A similar embodiment 118 as shown in FIG. 10B having a pillow/motor protector 120. The loss of charge condition is not only characterized by low mass flow rate but also by low suction pressure. When suction pressure is low, the pillow size will increase, and insulate the motor protector even more from the suction gas. When the suction pressure is high and the suction gas flow is also high, the suction gas temperature is low and the pillow contracts. This will allow the suction gas to flow over the motor protector.

Figure 11:
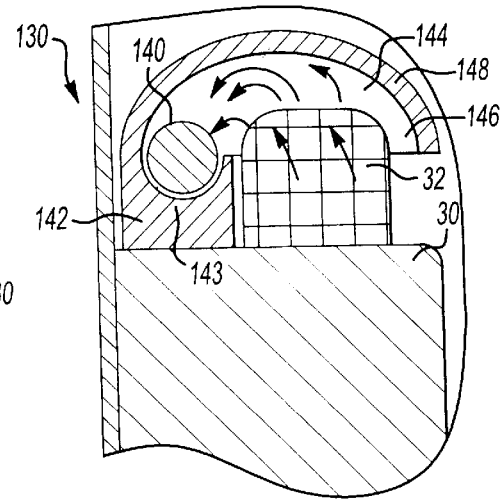
FIG. 11 shows an eleventh embodiment scroll compressor.

FIG. 11 shows another embodiment 130 wherein the motor protector 140 is positioned within a protector holder 142 having a nest 143. Clearance 144 receives airflow from a passage 146 defined by a forward end 148. The suction gas flow cools the protector, but as mass flow volume is reduced, more and more of the motor heat is convected to the protector.

Several preferred embodiments of this invention are disclosed. However, a worker in this art would recognize that other modifications would come within the scope of this invention. For that reason the following claims should be studied to determine the true scope and content of this invention.

What is claimed:

1. A scroll compressor comprising:

a first scroll member having a base and a generally spiral wrap extending from said base;

a second scroll member having a base and a generally spiral wrap extending from its base, a driveshaft for driving said second scroll member to orbit relative to said first scroll member, said driveshaft being driven by an electric motor having a rotor fixed to said shaft for driving said shaft and a stator for driving said rotor, said stator having windings;

a motor protector for sensing conditions within said compressor and stopping operation of said motor if conditions indicate an anomaly, and a suction tube extending through a housing for said compressor, said suction tube communicating refrigerant into said housing to cool said motor protector, with said motor protector being positioned to be sensitive to said flow of refrigerant at a position spaced from a winding of said stator; and a baffle positioned radially inward of said suction and directing suction refrigerant flow in a direction having a component toward said protector.

2. A scroll compressor as recited in claim 1, wherein said motor protector is positioned axially spaced from said winding in a direction toward said suction tube.

3. A scroll compressor as recited in claim 1, wherein said motor protector is positioned spaced in a axial direction toward said suction tube, from said winding.

4. A scroll compressor as recited in claim 3, wherein said motor protector is axially aligned with said suction tube.

5. A scroll compressor comprising:

a first scroll member having a base and a generally spiral wrap extending from said base;

a second scroll member having a base and a generally spiral wrap extending from its base, a driveshaft for driving said second scroll member to orbit relative to said first scroll member, said driveshaft being driven by an electric motor having a rotor fixed to said shaft for driving said shaft and a stator for driving said rotor, said stator having windings;

a motor protector for sensing conditions within said compressor and stopping operation of said motor if conditions indicate an anomaly, and a suction tube extending through a housing for said compressor, said suction tube communicating refrigerant into said housing to cool said motor protector, with said motor protector being positioned to be sensitive to said flow of refrigerant at a position spaced from a winding of said stator; and a holder positioning said motor protector axially above said winding and in line with said suction tube, such that said motor protector is positioned radially inwardly of said suction tube and at the same axial position along said driveshaft.

6. A scroll compressor comprising:

a first scroll member having a base and a generally spiral wrap extending from said base;

a second scroll member having a base and a generally spiral wrap extending from its base, a driveshaft for driving said second scroll member to orbit relative to said first scroll member, said driveshaft being driven by an electric motor having a rotor fixed to said shaft for driving said shaft and a stator for driving said rotor, said stator having windings;

a motor protector for sensing conditions within said compressor and stopping operation of said motor if conditions indicate an anomaly, and a suction tube extending through a housing for said compressor, said suction tube communicating refrigerant into said housing to cool said motor protector, with said motor protector being positioned to be sensitive to said flow of refrigerant at a position spaced from a winding of said stator; and a heat tube communicates from said motor protector to a position in line with said suction tube, said heat tube being formed of a temperature sensitive material such that said heat tube takes heat away from said motor protector when cooled by a refrigerant.

7. A scroll compressor as recited in claim 6, wherein a suction baffle is positioned on an opposed side of said heat tube from said suction tube.

8. A scroll compressor as recited in claim 1, wherein said windings of said stator include start windings, said start windings surrounding said motor protector, and said suction refrigerant cooling said motor protector when flowing over said motor protector.

9. A scroll compressor comprising:

a first scroll member having a base and a generally spiral wrap extending from said base;

a second scroll member having a base and a generally spiral wrap extending from its base, a driveshaft for driving said second scroll member to orbit relative to said first scroll member, said driveshaft being driven by an electric motor having a rotor fixed to said shaft for driving said shaft and a stator for driving said rotor, said stator having windings;

a motor protector for sensing conditions within said compressor and stopping operation of said motor if conditions indicate an anomaly, and a suction tube extending through a housing for said compressor, said suction tube communicating refrigerant into said housing to cool said motor protector, with said motor protector being positioned to be sensitive to said flow of refrigerant at a position spaced from a winding of said stator; and a material positioned between said suction refrigerant and said motor protector, said material becoming less thermally conductive at higher temperatures, such that at higher temperatures less heat is taken away from said motor protector by a constant volume of refrigerant.

10. A scroll compressor comprising:

a first scroll member having a base and a generally spiral wrap extending from said base;

a second scroll member having a base and a generally spiral wrap extending from its base, a driveshaft for driving said second scroll member to orbit relative to said first scroll member, said driveshaft being driven by an electric motor having a rotor fixed to said shaft for driving said shaft and a stator for driving said rotor, said stator having windings;

a motor protector for sensing conditions within said compressor and stopping operation of said motor if conditions indicate an anomaly, and a suction tube extending through a housing for said compressor, said suction tube communicating refrigerant into said housing to cool said motor protector, with said motor protector being positioned to be sensitive to said flow of refrigerant at a position spaced from a winding of said stator; and said motor protector is positioned adjacent to a fluid filled pillow, said fluid filled pillow expending when heated, such that said fluid filled pillow insulates said motor protector to a greater extent from suction gas flow as the temperature of said suction refrigerant increases.

11. A scroll compressor comprising:

a first scroll member having a base and a generally spiral wrap extending from said base;

a second scroll member having a base and a generally spiral wrap extending from its base, a driveshaft for driving said second scroll member to orbit relative to said first scroll member, said driveshaft being driven by an electric motor having a rotor fixed to said shaft for driving said shaft and a stator for driving said rotor, said stator having windings;

a motor protector for sensing conditions within said compressor and stopping operation of said motor if conditions indicate an anomaly, and a suction tube extending through a housing for said compressor, said suction tube communicating refrigerant into said housing to cool said motor protector, with said motor protector being positioned to be sensitive to said flow of refrigerant at a position spaced from a winding of said stator; and said motor protector is positioned within a shell that also surrounds said winding, but has a space for allowing refrigerant to flow between said winding and said shell, and said shell making said motor protector more sensitive to the flow of refrigerant.

12. A scroll compressor comprising:

a first scroll member having a base and a generally spiral wrap extending from said base;

a second scroll member having a base and a generally spiral wrap extending from its base, a driveshaft for driving said second scroll member to orbit relative to said first scroll member, said driveshaft being driven by an electric motor having a rotor fixed to said shaft for driving said shaft and a stator for driving said rotor, said stator having windings;

a motor protector for sensing conditions within said compressor and stopping operation of said motor if conditions indicate an anomaly, and a suction tube extending through a housing for said compressor, said suction tube communicating refrigerant into said housing to cool said motor protector, with said motor protector being positioned to be sensitive to said flow of refrigerant at a position spaced from a winding of said stator; and a baffle positioned inward of said suction tube directing suction refrigerant flow in a direction having a component toward said protector, wherein motor protector is positioned radially outwardly of said winding.

13. A scroll compressor as recited in claim 12, wherein said protector is axially aligned with said at least a portion of said winding.

* * * * *